US006267050B1

(12) United States Patent
Brewer

(10) Patent No.: US 6,267,050 B1
(45) Date of Patent: Jul. 31, 2001

(54) QUICK ACCESS/ADJUSTMENT PISTON

(75) Inventor: Craig Brewer, Minster, OH (US)

(73) Assignee: The Minster Machine Company, Minster, OH (US)

( * ) Notice: Subject to any disclaimer, the term of this patent is extended or adjusted under 35 U.S.C. 154(b) by 0 days.

(21) Appl. No.: 09/199,662

(22) Filed: Nov. 25, 1998

(51) Int. Cl.[7] ..... B30B 15/00
(52) U.S. Cl. ..... 100/257; 72/448; 83/530
(58) Field of Search ..... 100/257; 72/446, 72/448; 83/530, 640

(56) References Cited

U.S. PATENT DOCUMENTS

| | | | | |
|---|---|---|---|---|
| 2,102,842 | | 12/1937 | Glasner . | |
| 3,225,686 | | 12/1965 | Clements . | |
| 3,858,432 | | 1/1975 | Voorhees et al. . | |
| 3,889,515 | | 6/1975 | Grombka . | |
| 4,289,066 | * | 9/1981 | Proga | 100/257 |
| 4,502,379 | | 3/1985 | Sato . | |
| 4,620,352 | | 11/1986 | Sulej . | |
| 5,345,861 | | 9/1994 | Brewer et al. . | |
| 5,349,902 | | 9/1994 | Daniel et al. . | |
| 5,398,601 | * | 3/1995 | Schockman et al. | 100/257 |
| 5,445,072 | * | 8/1995 | Yagi et al. | 100/257 |
| 5,609,099 | * | 3/1997 | Burns et al. | 100/257 |
| 5,682,813 | * | 11/1997 | Brewer et al. | 100/257 |

* cited by examiner

*Primary Examiner*—Stephen F. Gerrity
(74) *Attorney, Agent, or Firm*—Randall J. Knuth

(57) ABSTRACT

An hydraulic piston-cylinder assembly configured within a press machine enables adjustments to be made to the shutheight parameter through changes in the positioning of the bed in accordance with hydraulic pressure variations in the piston-cylinder assembly. The cylinder device, which is arranged to be reversibly movable with respect to the piston device under the influence of the pressure variations, is coupled to the bed such that movements of the cylinder device induce a corresponding displacement of the bed, thereby changing the shutheight. The piston device is characterized by a property of tensile elasticity in at least one dimension thereof substantially coincident with the shutheight dimension. Accordingly, in one operating mode, there may be effectuated a reversible displacement of the cylinder device beyond its established range-of-motion by changing the hydraulic pressurization of the piston-cylinder assembly in a manner sufficient to induce an elastic tensile effect in the piston device.

49 Claims, 5 Drawing Sheets

QUICK ACCESS/ADJUSTMENT PISTON

BACKGROUND OF THE INVENTION

1. Field of the Invention

The present invention relates generally to mechanical press machines and, more particularly, to a bed adjustment assembly including a piston-cylinder arrangement which enables micro-adjustments to be made to the shutheight parameter by utilizing a piston device having elastic tensile properties.

2. Description of the Related Art

Mechanical presses of the type performing stamping and drawing operations have a conventional construction comprising a frame including a crown and bed portion and a slide supported within the frame for reciprocating movement toward and away from the bed. The slide is driven by a crankshaft having a connecting arm coupled to the slide. These mechanical presses are widely used for a variety of workpiece operations employing a diverse array of die sets, with the press machine varying substantially in size and available tonnage depending upon its intended use. The availability of a diverse selection of die sets for installation into the press machines requires an adjustment capability that tailors the shutheight dimension to the particular configuration of press machine and die assembly.

One conventional press arrangement employs a slide configured for connection to the crankshaft by a connecting rod that is adjustable in length or which is connected to another device such as a connection screw that is adjustable in its spatial separation from the slide, thereby permitting adjustments to the shutheight dimension in order to accommodate various die sets. Adjustment mechanisms of the type employing an adjustable connecting rod or connection screw have typically been arranged such that the actuating mechanism is disposed within the slide, requiring that any shutheight adjustments be made only through changes in the position of the slide relative to the bed. In one such arrangement a plurality of connection screw assemblies configured with the slide may be adjusted simultaneously by means of a worm-gear arrangement, which is driven either manually or by means of an operator controlled motor. This adjustment procedure changes the position of the slide relative to each of the connection screws to thereby effect a change in the shutheight. However, the amount of slide displacement available from such screw-based arrangements is limited by dimensional considerations relating, for example, to the size of the screw, e.g., its longitudinal extent. Additionally, such arrangements provide a low order of efficiency in terms of their ability to make rapid changes in the shutheight, instead allowing more incrementally gradual changes as the screw needs to be sufficiently driven to produce the appropriate amount of slide-displacing rotational activity. The conventional strategy which relies upon making adjustments to the slide position to achieve shutheight variations is not always compatible with press machine configurations in which the crown area does not provide adequate space or support for housing the needed assembly of connection screws, for example. Moreover, adjustment mechanisms having a high part count such as the multi-screw arrangement are more susceptible to malfunction from parts failure, inhibiting efforts to reliably maintain the press machine.

In another proposed conventional configuration, an adjustment member extends between the crown and bed of the press machine and acts to adjust the gap therebetween by exerting a force on the crown, as disclosed in U.S. Pat. No. 4,502,379. Columns are provided at the four corners of the frame to support the crown, while elastic tie rods are arranged to extend through the columns from the crown to the bed to establish a supporting connection therebetween. Adjustment members in the form of a piston-cylinder arrangement are provided next to the support columns and extend between the crown and bed in the form of a columnar structure. Each piston-cylinder device operates in response to changes in its hydraulic pressurization to generate a force that acts upon the crown to vary its position, which is made possible by the tie rods since they are caused to be stretched within their elastic limits under the separating force generated by the piston-cylinder arrangement. The upward crown displacement and accompanying tie rod extension produce a change in the shutheight between the slide and bed. This configuration, however, has certain drawbacks; for example, housing the piston-cylinder assembly within the shutheight area between the crown and bed may create an obstruction that interferes with attempts by the operator to access the die set for servicing or other purposes.

In another proposed configuration there is provided an apparatus for adjusting the bed member of the press machine that employs an arrangement of piston rods connected to the corners of the bed member at an upper side thereof facing the crown. These piston rods extend upwardly into respective stationary cylinders which, at their upper ends, are fixed to the press frame. Adjustments are made to the bed position by varying the piston displacement. This arrangement, which is disclosed in U.S. Pat. No. 3,858,432, is likewise characterized by its placement of the adjusting mechanism (i.e., piston-cylinder assembly) in overlying relationship to the bed and interposed between the crown and bed. The piston rods in this configuration are required to bear the entire lifting burden in a relatively non-distributed manner at least in the lateral dimensions because of the primarily longitudinal strength profile typical of a piston device. This force distribution may introduce certain limitations with regard to the weight bearing capacity of the piston rods and hence the range of achievable shutheight variations.

SUMMARY OF THE INVENTION

The present invention describes an assembly for use in a press machine that enables adjustments to be made to the shutheight parameter through controllable changes in the positioning of the bed. The assembly comprises an hydraulic piston-cylinder arrangement including a piston device having a property of tensile elasticity in at least one dimension thereof substantially coincident with the shutheight dimension, and a cylinder device integral with the piston device and which is operatively reversibly movable in response to change in the pressurization of at least one variably pressurized fluid chamber defined by the piston device and cylinder device. The cylinder device is coupled to the bed such that movements of the cylinder device induce a corresponding displacement of the bed, thereby changing the shutheight. A mechanism provided in the form of an integral nut-screw combination is arranged to adjustably define, at least in part, the range-of-motion for the operative movement of the cylinder device. In particular, the mechanism includes a non-rotatable threaded screw member integrally attached to, and displaceable along, the piston device, and further includes a rotatable threaded nut member threadedly engaged to the non-rotatable threaded screw member. The screw member is arranged to enable abutting engagement with a head portion of the piston device to create an adjustable stopping point that defines the range-of-motion for the cylinder device. In one operating mode, there may be effectuated a reversible displacement of the cylinder device beyond the defined range-of-motion by changing the hydraulic pressurization of the variably pressurized fluid chamber in a manner sufficient to induce an elastic tensile effect in the piston device.

The invention, in one form thereof, is directed to an assembly for use in a press machine having a position-adjustable bed. The assembly comprises an hydraulic piston-cylinder means arranged in adjustable supporting relationship to the bed and which includes a piston member and a cylinder member integral therewith and coupled to the bed. The cylinder member together with the piston member defines at least one variably pressurized fluid chamber. The cylinder member is operatively reversibly movable in response to changes in the pressurization of the at least one variably pressurized fluid chamber. The piston member is characterized by a property of tensile elasticity in at least one dimension thereof substantially coincident with a shutheight dimension of the press machine. An adjustment means, which is coupled to the cylinder member of the hydraulic piston-cylinder means, provides an adjustable stopping point to the movement of the cylinder member. There is further provided a means for controlling the pressurization of the hydraulic piston-cylinder means via hydraulic action in the variably pressurized fluid chamber. The pressurization control means is operable in at least one mode thereof to effectuate a reversible displacement of the cylinder member relative to the adjustable stopping point provided by the adjustment means by changing the pressurization of the hydraulic piston-cylinder means in a manner sufficient to induce an elastic tensile effect in the piston member.

The at least one variably pressurized fluid chamber, in one form thereof, further includes a first variably pressurized fluid chamber formed at an interior space of the piston member and a second variably pressurized fluid chamber formed in a space defined between the piston member and the cylinder member and which is arranged in fluid communication with the first variably pressurized fluid chamber. The piston member includes a head portion integral with a body portion, the body portion including at least a wall member being arranged to define, at least in part, the first variably pressurized fluid chamber and having suitable dimensional characteristics to accommodate an elastic tensile effect therein. The cylinder member, in one form thereof, is coupled to the bed at an underside thereof.

The adjustment means, in one form thereof, further comprises a non-rotatable threaded screw member integrally attached to, and displaceable along, the piston member; and a rotatable threaded nut member threadedly engaged to the non-rotatable threaded screw member. The screw member is arranged to enable engagement thereof with a portion of the piston member to define the adjustable stopping point provided by the adjustment means. There is provided a means for controllably rotatingly driving the rotatable nut member to effect a variable displacement of the non-rotatable screw member. The screw member and the nut member are arranged, in one form thereof, to move in tandem with the cylinder member, wherein the nut member is coupled to the cylinder member of the hydraulic piston-cylinder means.

The assembly, in one form thereof, further includes a means for sealably defining a chamber encompassing at least the threaded engagement between the screw member and the nut member of the adjustment means, and a means for providing lubricating fluid to the chamber.

The invention, in another form thereof, comprises a press machine including a frame structure with a crown and a position-adjustable bed; a slide guided by the frame structure for operative reciprocating movement in opposed relation to the bed; a drive means attached to the frame structure for operatively reciprocating the slide; a bolster assembly mounted to the bed; and an hydraulic piston-cylinder means for adjustably supporting the bed and being operatively effective in controllably reversibly displacing the bed in response to controllable changes in the pressurization of the hydraulic piston-cylinder means. The hydraulic piston-cylinder means includes a piston member and a cylinder member integral therewith and being coupled to the bed, the cylinder member and the piston member together defining at least one variably pressurized fluid chamber. The cylinder member is operatively reversibly movable in response to pressure variations in the at least one variably pressurized fluid chamber. The piston member is characterized by a property of tensile elasticity in at least one dimension thereof substantially coincident with a shutheight dimension of the press machine. An adjustment means, which is coupled to the cylinder member, provides an adjustable stopping point to the movement of the cylinder member. There is further provided a means for controlling the pressurization of the hydraulic piston-cylinder means via hydraulic action in the at least one variably pressurized fluid chamber. The pressurization control means is operable in at least one mode thereof to effectuate a reversible displacement of the cylinder member relative to the adjustable stopping point provided by the adjustment means by changing the pressurization of the hydraulic piston-cylinder means in a manner sufficient to induce an elastic tensile effect in the piston member.

The at least one variably pressurized fluid chamber further includes, in one form thereof, a first variably pressurized fluid chamber formed at an interior space of the piston member, and a second variably pressurized fluid chamber formed in a space defined between the piston member and the cylinder member and being arranged in fluid communication with the first variably pressurized fluid chamber.

The adjustment means, in one form thereof, further includes a non-rotatable threaded screw member integrally attached to, and displaceable along, the piston member of the hydraulic piston-cylinder means; and a rotatable threaded nut member threadedly engaged to the non-rotatable threaded screw member. The screw member is arranged to enable engagement thereof with a portion of the piston member to define the adjustable stopping point provided by the adjustment means.

The invention, in another form thereof, relates to an assembly for use in a press machine having a position-adjustable bed. The assembly includes a piston member having a property of tensile elasticity in at least one dimension thereof substantially coincident with a shutheight dimension of the press machine; and further includes a cylinder member integral with the piston member and being coupled to the bed; wherein the piston member and the cylinder member together define at least one variably pressurized fluid chamber, and the cylinder member is operatively reversibly movable in response to controllable pressure variations in the at least one variably pressurized fluid chamber. The assembly further includes a mechanism coupled to the cylinder member and being arranged to adjustably define, at least in part, the range-of-motion for the operative movement of the cylinder member. A means is provided for controlling the pressurization of the at least one variably pressurized fluid chamber via hydraulic action therein. The pressurization control means is operable in at least one mode thereof to effectuate a reversible displacement of the cylinder member beyond the range-of-motion defined by the mechanism by changing the pressurization of the at least one variably pressurized fluid chamber in a manner sufficient to induce an elastic tensile effect in the piston member.

The at least one variably pressurized fluid chamber further comprises, in one form thereof, a first variably pressurized fluid chamber formed at an interior space of the piston member, and a second variably pressurized fluid chamber formed in a space defined between the piston member and the cylinder member and being arranged in fluid communication with the first variably pressurized fluid chamber. The piston member includes a head portion integral with a body portion, the body portion including at least a wall member being arranged to define, at least in part, the first variably pressurized fluid chamber and having suitable dimensional characteristics to accommodate an elastic tensile effect therein.

The mechanism, in one form thereof, further comprises a non-rotatable threaded screw member integrally attached to, and displaceable along, the piston member; and a rotatable threaded nut member threadedly engaged to the non-rotatable threaded screw member, wherein the screw member is arranged to enable engagement thereof with a portion of the piston member to define, at least in part, the range-of-motion for the operative movement of the cylinder member. The screw member and the nut member are arranged to move in tandem with the cylinder member, wherein the nut member is coupled to the cylinder member. The portion of the piston member with which the screw member is arranged to enable engagement therewith in association with defining the range-of-motion for the cylinder member is a head portion thereof.

The assembly further includes a means for defining a chamber encompassing at least the threaded engagement between the screw member and the nut member of the mechanism, and a means for providing lubricating fluid to the chamber.

The invention, in yet another form thereof, comprises a press machine including a frame structure with a crown and a position-adjustable bed; a slide guided by the frame structure for operative reciprocating movement in opposed relation to the bed; a drive means attached to the frame structure for operatively reciprocating the slide; a bolster assembly mounted to the bed; and an assembly for use in the press machine, wherein the assembly comprises a piston member having a property of tensile elasticity in at least one dimension thereof substantially coincident with a shutheight dimension of the press machine, and a cylinder member integral with the piston member and being coupled to the bed. The piston member and the cylinder member together define at least one variably pressurized fluid chamber, with the cylinder member being operatively reversibly movable in response to controllable pressure variations in the at least one variably pressurized fluid chamber. The assembly further includes a mechanism coupled to the cylinder member and being arranged to adjustably define, at least in part, the range-of-motion for the operative movement of the cylinder member. A means is also provided for controlling the pressurization of the at least one variably pressurized fluid chamber via hydraulic action therein. The pressurization control means is operable in at least one mode thereof to effectuate a reversible displacement of the cylinder member beyond the range-of-motion defined by the mechanism by changing the pressurization of the at least one variably pressurized fluid chamber in a manner sufficient to induce an elastic tensile effect in the piston member.

The at least one variably pressurized fluid chamber further comprises, in one form thereof, a first variably pressurized fluid chamber formed at an interior space of the piston member, and a second variably pressurized fluid chamber formed in a space defined between the piston member and the cylinder member and being arranged in fluid communication with the first variably pressurized fluid chamber.

The mechanism, in one form thereof, further includes a non-rotatable threaded screw member integrally attached to, and displaceable along, the piston member; and a rotatable threaded nut member threadedly engaged to the non-rotatable threaded screw member, wherein the screw member is arranged to enable engagement thereof with a portion of the piston member to define, at least in part, the range-of-motion for the operative movement of the cylinder member.

The press machine further includes a means for defining a chamber encompassing at least the threaded engagement between the screw member and the nut member of the mechanism; and a means for providing lubricating fluid to the chamber.

The invention, in yet another form thereof, is directed to a method of changing the shutheight of a press machine having a position-adjustable bed. The method comprises: the step of providing an hydraulic piston-cylinder arrangement including a piston member having a property of tensile elasticity in at least one dimension thereof substantially coincident with a shutheight dimension of the press machine, and further including a cylinder member integral with the piston member and being coupled to the bed, wherein the cylinder member is arranged for operative reversible movement in response to controllable changes in the hydraulic pressurization of the hydraulic piston-cylinder arrangement, the cylinder member being provided with an adjustable stopping point in regard to the operative movement thereof; and the step of selecting a range-of-motion for the cylinder member in association with a non-tensile state of the piston member and then effectuating the selected range-of-motion by making any needed changes to the adjustable stopping point for the cylinder member. In a first operating mode of the hydraulic piston-cylinder arrangement characterized by the piston member being in a non-tensile state, the shutheight adjustment method further includes the step of executing the step of selectively varying the hydraulic pressurization of the piston-cylinder arrangement to effect a reversible movement of the cylinder member, wherein the extent of such reversible movement being subject to the effectuated range-of-motion. In a second operating mode of the hydraulic piston-cylinder arrangement characterized by the piston member being in a tensile state, the shutheight adjustment method further includes the step of executing the step of selectively varying the hydraulic pressurization of the piston-cylinder arrangement in a manner sufficient to induce an elastic tensile effect in the piston member which permits reversible movements of the cylinder member beyond the effectuated range-of-motion.

The method, in one form thereof, further comprises the step of providing the piston-cylinder arrangement with at least one variably pressurized fluid chamber defined by the piston member and the cylinder member; and the step of effectuating a variable hydraulic action in the at least one variably pressurized fluid chamber to control the hydraulic pressurization of the hydraulic piston-cylinder arrangement.

The method, in another form thereof, further includes the step of providing a mechanism coupled to the cylinder member of the hydraulic piston-cylinder arrangement and being arranged to adjustably define, at least in part, the range-of-motion for the operative movement of the cylinder member. Such mechanism includes a non-rotatable threaded screw member integrally attached to, and displaceable along, the piston member, and a rotatable threaded nut member threadedly engaged to the non-rotatable threaded screw member, wherein the screw member is arranged to enable engagement thereof with a portion of the piston member to define, at least in part, the range-of-motion for the operative movement of the cylinder.

There is further provided the steps of defining a chamber to encompass at least the threaded engagement between the screw member and the nut member of the mechanism; and providing the chamber with lubricating fluid.

The invention, in still yet another form thereof, relates to an assembly for use in a press machine having a position-adjustable bed. The assembly includes an hydraulic piston-cylinder means for adjustably supporting the bed at an underside thereof and which is operatively effective in variably displacing the bed in response to controllable changes in the pressurization of the hydraulic piston-cylinder means. The assembly further includes a means for controlling the pressurization of the hydraulic piston-cylinder means.

The hydraulic piston-cylinder means, in one form thereof, further comprises a stationary piston member and a cylinder member integral with the stationary piston member and which is coupled to the bed. The piston member and the cylinder member together define at least one variably pressurized fluid chamber, with the cylinder member being operatively reversibly movable in response to controllable pressure variations in the at least one variably pressurized fluid chamber. The stationary piston member, in one form thereof, is characterized by a property of tensile elasticity in at least one dimension thereof substantially coincident with a shutheight dimension of the press machine.

The assembly further includes a mechanism coupled to the cylinder member of the hydraulic piston-cylinder means and which is arranged to adjustably define, at least in part, the range-of-motion for the operative movement of the cylinder member. The pressurization control means is operable in at least one mode thereof to effectuate a reversible displacement of the cylinder member beyond the range-of-motion defined by the mechanism by changing the pressurization of the at least one variably pressurized fluid chamber in a manner sufficient to induce an elastic tensile effect in the piston member.

The mechanism, in one form thereof, comprises a non-rotatable threaded screw member integrally attached to, and displaceable along, the piston member, and a rotatable threaded nut member threadedly engaged to the non-rotatable threaded screw member. The screw member is arranged to enable engagement thereof with a portion of the piston member to define, at least in part, the range-of-motion for the operative movement of the cylinder member.

The at least one variably pressurized fluid chamber further includes a first variably pressurized fluid chamber formed at an interior space of the piston member, and a second variably pressurized fluid chamber formed in a space defined between the piston member and the cylinder member and being arranged in fluid communication with the first variably pressurized fluid chamber. The piston member of the hydraulic piston-cylinder means includes a head portion integral with a body portion, the body portion including at least a wall member being arranged to define, at least in part, the first variably pressurized fluid chamber and having suitable dimensional characteristics to accommodate an elastic tensile effect therein.

One advantage of the shutheight adjustment assembly according to the present invention is that the elastic tensile properties of the piston device effectively enable a range of micro-adjustments to be made to the shutheight dimension beyond the point at which conventional piston-cylinder arrangements become inactive for reasons such as either the piston device or cylinder device has encountered the motion interference mechanism (e.g., the nut-screw combination of the present invention) that inhibits any further motion of the bed-displacing device; accordingly, the present invention effectively extends the operating range that is available to the operator for making adjustments to the shutheight.

Another advantage of the present invention is that the shutheight adjustment assembly is able to support both one operating mode characterized by macro-adjustments to the shutheight dimension through relatively large-scale displacements of the cylinder relative to the piston and another operating mode characterized by micro-adjustments to the shutheight dimension through comparatively small-scale displacements of the cylinder device that arise from micro-extensions of the piston device which are accommodated by its elastic tensile properties.

Another advantage of the present invention is that the nut-screw arrangement is contained within a sealed chamber that is provided with fluid to create a continuous oil film at the threaded engagement between the nut and screw that serves to lubricate the parts and form a weight-bearing shear film that allows the mechanism to sustain higher impact forces without experiencing fretting or other force-induced damage.

Another advantage of the present invention is that the assembly is preferably configured entirely within the lower end of the press machine (i.e., at the underside of the bed), eliminating the problems associated with conventional placements within the upper end of the press machine (i.e., within the slide) or interposed between the crown and bed.

Another advantage of the present invention is that the piston-cylinder arrangement is configured with the movable cylinder member providing the direct bearing support to the bed, which is preferable to alternative forms utilizing the piston member as the force-transmitting component since the cylinder provides a wider area over which the bearing support and displacing force may be distributed and applied to the bed, creating a more favorable condition of stability and reducing the risk of stress-related component failure more likely to be associated with piston-type connecting links.

Another advantage of the present invention is that the piston-cylinder arrangement is highly responsive to changes in its hydraulic pressurization, allowing rapid actuation of the cylinder and accompanying displacement of the bed in a manner that permits quick and ready access to the die assembly area for executing tool set-up, for example.

Another advantage of the present invention is that the piston-cylinder arrangement supports a range of bed adjustment activity covering both pre-operational requirements (i.e., tool set-up and die loading) and in-cycle modifications (i.e., adjustment-in-motion changes to the shutheight).

Another advantage of the present invention is that the shutheight adjustment assembly may be incorporated into a control system for automatically modifying the shutheight in accordance with measurement data obtained from a production monitoring system.

Another advantage of the present invention is that the shutheight adjustment assembly includes a variety of features not heretofore combined in the manner of the present invention, namely the use of a piston-cylinder arrangement to adjustably support the bed at its underside; configuring the piston-cylinder arrangement in a manner such that the movable cylinder provides the direct bearing support; and employing a piston device with an elastic tensile capability that permits a micro-adjustment operating mode that effectively extends the shutheight adjustment range.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
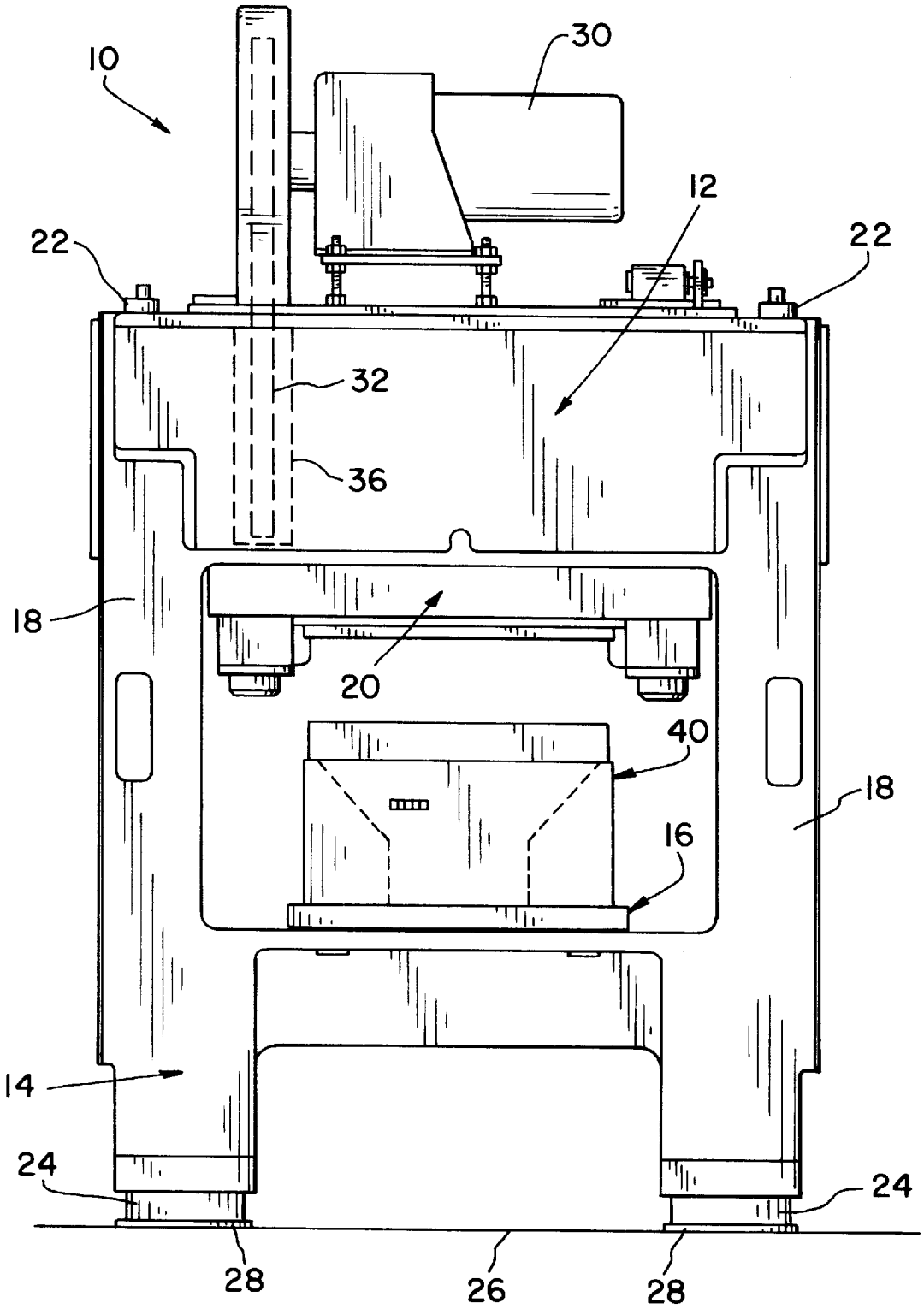
FIG. 1 is a front elevational view of a press machine in one illustrative form thereof incorporating the shutheight adjustment assembly of the present invention.

The adjustment assembly of the present invention may be installed within machines of the mechanical press type. Accordingly, reference is first made by way of background to FIG. 1, in which there is shown a mechanical press 10 of conventional form including a crown portion 12, a bed portion 14 having a bolster assembly 16 connected thereto, and uprights 18 connecting crown portion 12 with bed portion 14. Uprights 18 are connected to or integral with the underside of crown 12 and the upper side of bed 14. A slide 20 is positioned between uprights 18 for controlled reciprocating movement between crown 12 and bed 14. Tie rods (not shown), which extend through crown 12, uprights 18 and bed portion 14, are attached at each end with tie rod nuts 22. Leg members 24 are formed as an extension of bed 14 and are generally mounted on shop floor 26 by means of shock absorbing pads 28. A drive press motor 30, which is part of the drive mechanism, is attached by means of a belt 32 to the main flywheel of the combination clutch/brake assembly, depicted generally at 36. This form of the press machine is described for illustrative purposes only as it should be apparent to those skilled in the art that the principles of the present invention may be practiced with, and incorporated into, other machine configurations. Press machine 10, when fully configured with a die assembly installed therein, further includes an upper die (not shown) generally located at area 38 and attached by known means in a conventional manner to the lower end of slide 20. A lower die (not shown) located generally at area 40 is attached by known means in a conventional manner to the upper end of bolster 16. The upper and lower dies, as so arranged in their opposing spaced-apart relationship, cooperate in a known manner during press operation to process a workpiece disposed therebetween, e.g., fastened to the lower die. The upper and lower dies together constitute a die set or assembly.

Figure 2:
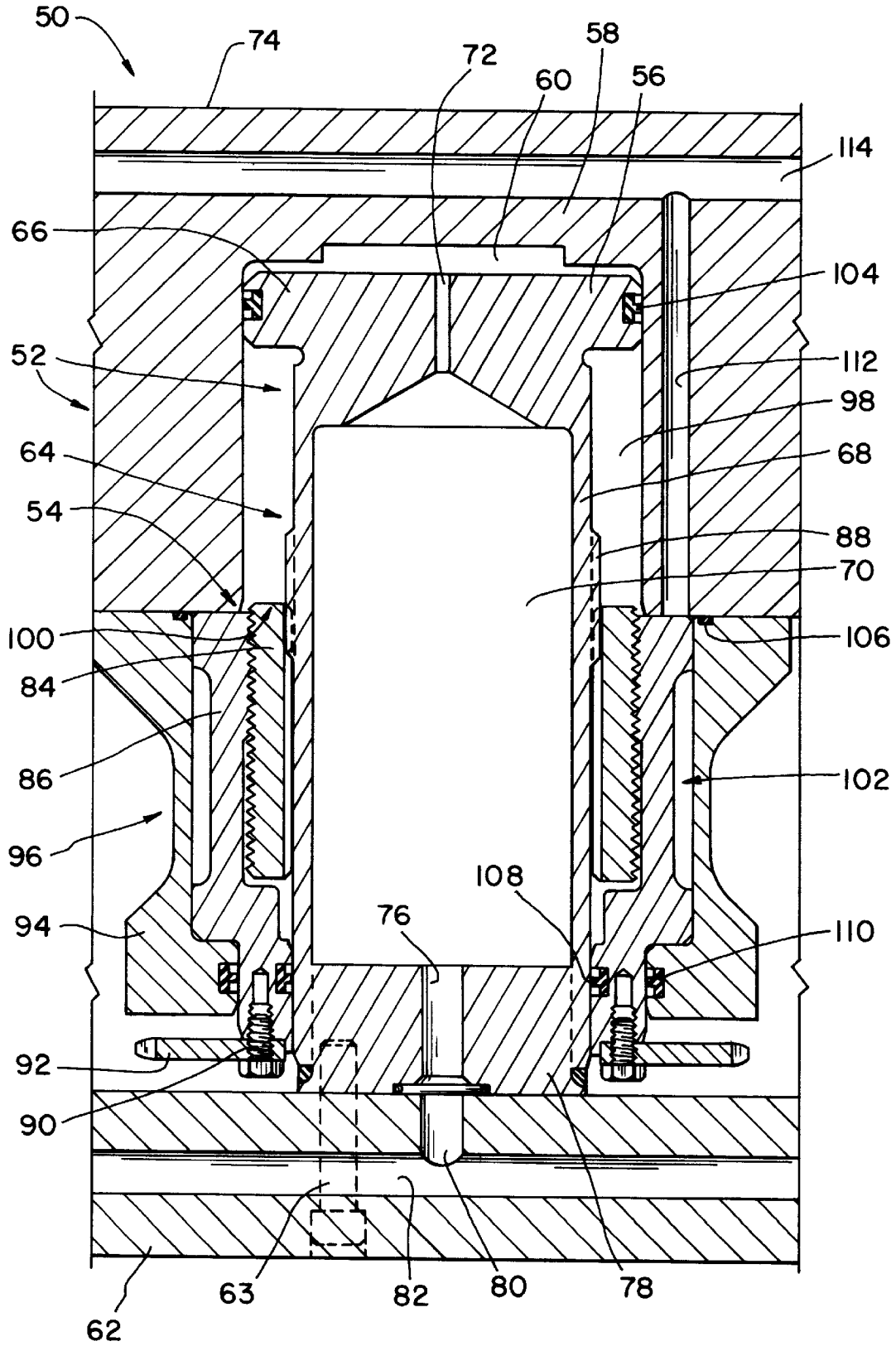
FIG. 2 is a cross-sectional schematic view of the shutheight adjustment assembly according to the present invention shown illustratively in a collapsed condition in which the piston-cylinder arrangement has not yet been activated with regard to making a shutheight adjustment.
Figure 3:
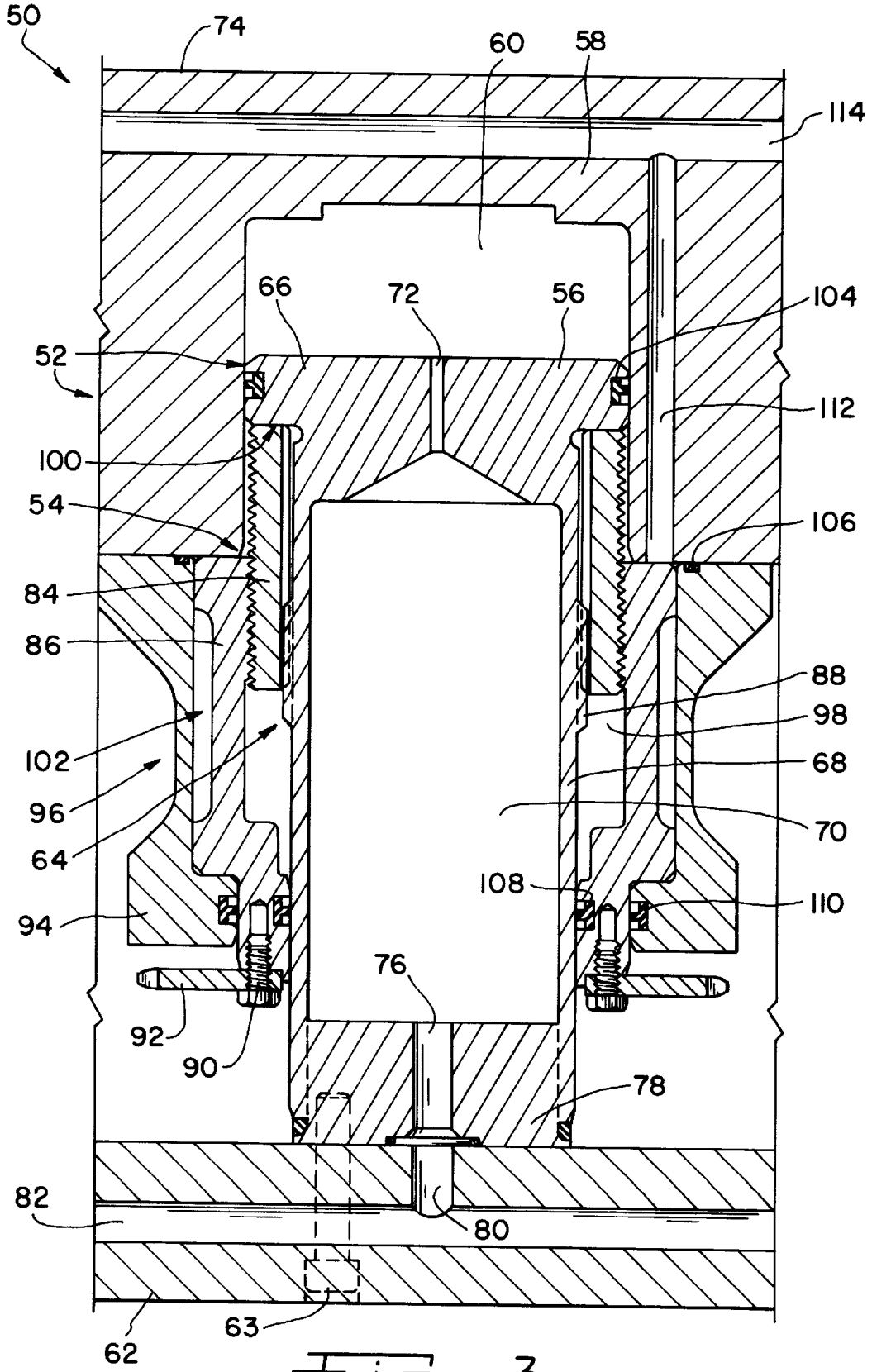
FIG. 3 is a cross-sectional schematic view of the shutheight adjustment assembly according to the present invention shown illustratively in an intermediate pressurization condition in which the piston-cylinder arrangement has been pressurized relative to its condition in FIG. 2 to cause a displacement of the cylinder device to an adjustable stop position that is determined by the indicated actuation of the nut-screw mechanism.
Figure 4:
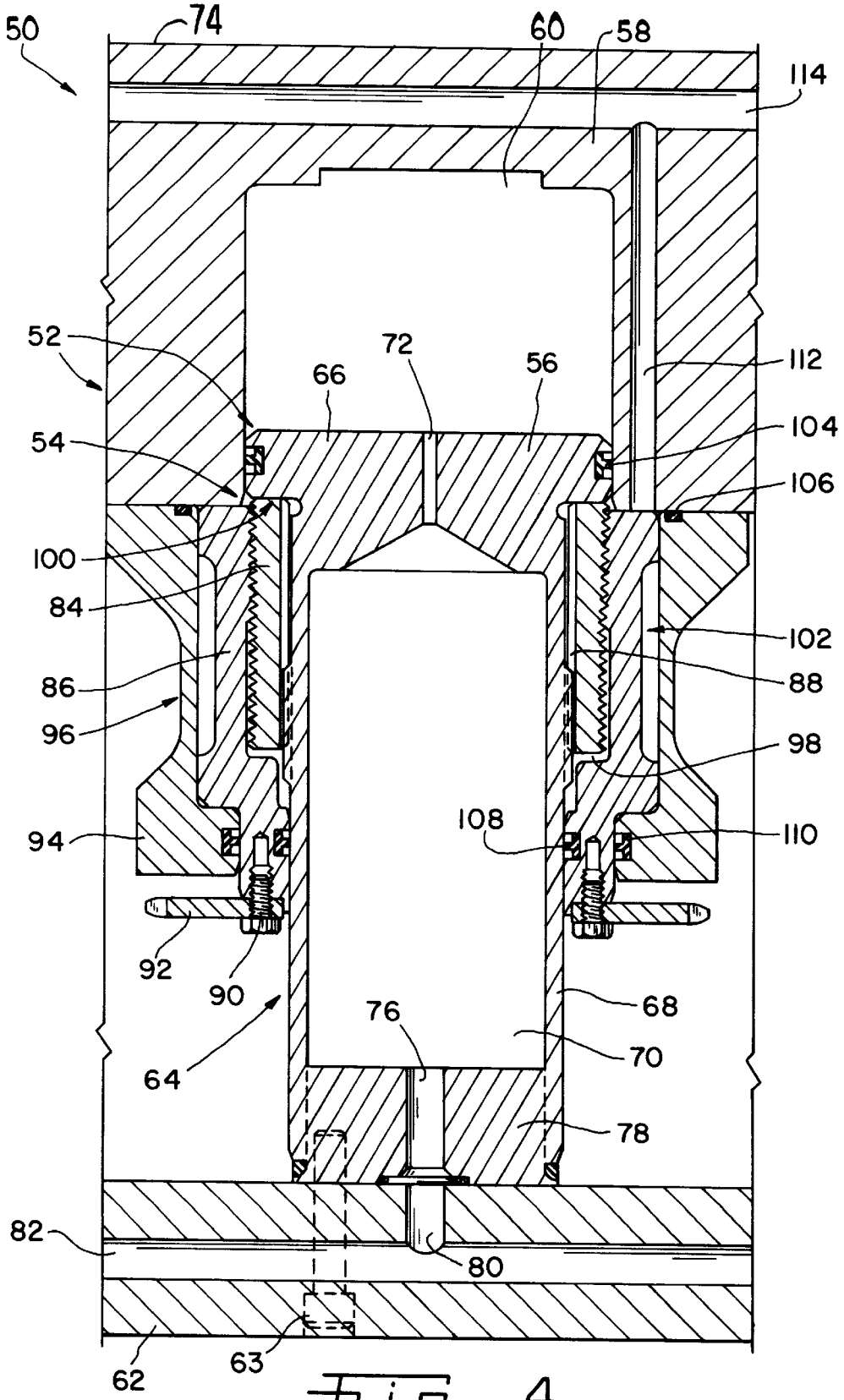
FIG. 4 is a cross-sectional schematic view of the shutheight adjustment assembly according to the present invention shown illustratively in a maximally pressurized condition in which the nut-screw mechanism has been returned to its non-actuated state (FIG. 1) while the piston-cylinder arrangement has been pressurized to its fullest extent allowable by the nut-screw combination so as to cause a maximum displacement of the cylinder device.

Referring now to the drawings, and particularly to FIGS. 2–4, there is shown a series of views of the shutheight adjustment assembly 50 according to the present invention as it is configured in a respective one of three illustrative operating conditions. FIG. 2 illustratively represents a starting point operating condition in which the piston-cylinder arrangement shown illustratively at 52 is placed at an initial pressurization level representing a baseline from which further increases in pressurization effect a displacement of the press machine bed. FIG. 3 illustratively represents an intermediate pressurization operating condition in which the piston-cylinder arrangement has been pressurized beyond the level corresponding to FIG. 2 up to an adjustable stopping point defined by a braking mechanism shown illustratively at 54 and which as shown has been actuated to effect an intermediate braking level. FIG. 4 illustratively represents a maximum pressurization operating condition in which the piston-cylinder arrangement has been fully pressurized to a point defined by braking mechanism 54 when configured as shown in its non-actuated state. According to the present invention, and as will be explained below in further detail, the piston device of piston-cylinder arrangement 52 is characterized by a property of tensile elasticity in at least one dimension thereof that is substantially coincident with a shutheight dimension of the press machine. This feature of the piston device enables the piston-cylinder arrangement 52 to be pressurized beyond the levels indicated by FIGS. 3 and 4 so as to accommodate a pressure range within which micro-adjustments may be made to the shutheight parameter, notwithstanding the fact that the braking mechanism 54 remains engaged with the piston-cylinder arrangement 52 in its braking or stopped/locked configuration.

Referring particularly to FIG. 2, the illustrated shutheight adjustment assembly 50 includes an hydraulic piston-cylinder arrangement 52 that is arranged to adjustably support the press machine bed and which comprises an integral piston device 56 and cylinder device 58 together defining, in one form thereof, at least one variably pressurized fluid chamber 60 formed therebetween that is useful in controllably changing the relationship of piston device 56 to cylinder device 58 and thus the position of the bed relative to the slide to thereby effect a shutheight adjustment. In the illustrated embodiment, piston-cylinder arrangement 52 is provided in a preferred form wherein piston 56 constitutes a stationary component and cylinder 58 constitutes a movable component such that cylinder 58 is operatively reversibly movable with respect to piston 56 in response to, and in accordance with, changes in the pressurization of variably pressurized fluid chamber 60. For purposes herein, the term "stationary" as applied to piston 56 should not be construed as being incompatible with the elastic tensile characteristic of piston 56, which will be described hereinafter in further detail. This stationary feature refers to the fact that piston 56, when considered as an integral whole, is arranged such that it cannot be displaced in its entirety, which is not mutually exclusive with the possibility that piston 56 may experience a certain tensile-related elongation or extensibility under the appropriate conditions as will be explained herein. For this purpose, piston 56 is fixedly secured by known means at a lower end thereof to immovable base plate 62 (e.g., using connecting screw 63 shown in phantom view), which may represent the lower-most portion of the press machine that can be adapted for attachment to the machine shop floor. Cylinder 58, in a preferred form thereof, is coupled to the press machine bed (not shown) at an underside thereof, such that piston 56 and cylinder 58 constitute in combination a means for adjustably supporting the bed. Accordingly, pressurization changes within piston-cylinder arrangement 52 at the variably pressurized fluid chamber 60 will effect a controllable displacement of the bed that results in variable adjustments to the shutheight dimension. For this purpose, the bed itself is configured to accommodate such adjustments, i.e., the bed is not immovably fixed to or within the press machine but is arranged for position adjustability.

The illustrated piston device 56, in accordance with one aspect of the present invention, is provided with an elastic tensile capability that permits a certain degree of reversible extensibility or "stretching" that enables micro-adjustments to be made to the shutheight parameter beyond the point at which further movement of cylinder 58 relative to piston 56 (in its non-tensile state) has been inhibited due to the braking action provided by braking mechanism 54, as will be discussed further. These micro-adjustments occur over a pressure range that induces reversible elongation of at least piston 56. Piston 56 includes, in one form thereof, a body portion shown illustratively at 64 that is integral with a head portion 66, wherein the elastic properties of piston 56 are developed, at least in part, by forming piston 56 at body portion 64 to have a thin outer sidewall structure 68 that is suitably arranged and dimensioned to support and accommodate a tensile effect therein. This particular shaping or "hollowing-out" of piston body portion 64 defines, at least in part, an interior space 70 that is used as a fluid chamber, which, in a preferred form thereof, is arranged for fluid communication with variably pressurized fluid chamber 60 via interconnecting fluid passageway 72 formed within piston head portion 66. Although in the illustrated embodiment the feature of tensile elasticity has been developed in piston 56 by providing it with a tensile-supporting sidewall structure 68 in body portion 64, this particular structural arrangement is simply illustrative of one possible shaping for piston 56, as it should be apparent that the present invention encompasses other designs and arrangements for piston 56 that create a functionality involving the capacity to support a tensile effect. In this regard, the design considerations may involve other factors such as material choice, suitable dimensioning, and any manufacturing techniques that favor the creation of a tensile-supporting structure.

Cylinder device 58, in one form thereof, is provided in the form of a cylindrical body having a recess area formed therein within which piston device 56 is disposed so as to define therebetween variably pressurized fluid chamber 60. In the illustrated configuration, cylinder 58 is annularly disposed about piston 56 and is arranged in guidedly slidable relationship therewith. Piston 56, in particular, serves in a known manner as a guide member for guiding the movement of cylinder 58 disposed thereabout. It should be understood that the illustrated piston-cylinder arrangement should not be considered in limitation of the present invention but that other configurations for piston 56 and cylinder 58 may be used without departing from the principles of the present invention.

Cylinder 58 may be provided in the form of an upper housing structure in which its upper surface 74 provides bearing support to the bed, preferably at its underside. This adjustable support may be implemented through direct engagement of cylinder 58 to the bed portion or by any other coupling means which enables reversible displacements of cylinder 58 to have a correspondingly similar effect on the bed vis-à-vis adjustment of the shutheight. For example, reversible movements of cylinder 58 may be communicated to the bed portion through intermediate support members interposed between cylinder 58 and the bed. The illustrated piston-cylinder arrangement 52 is preferably arranged to provide bearing support to the bed at its underside, although the present invention encompasses other support configurations between the bed and piston-cylinder arrangement 52. For example, the piston-cylinder arrangement 52, while still in an underlying orientation relative to the bed, may support the bed via interconnecting linkages that are secured to the bed at locations other than the underside, e.g., at lateral portions thereof. Additionally, an overlying orientation is possible in which the piston-cylinder arrangement 52 is arranged in such a manner that cylinder 58 provides supporting engagement to the bed at an upper side thereof facing the slide.

The illustrated variably pressurized fluid chamber 60 disposed between and defined by piston 56 and cylinder 58 is preferably arranged as shown for fluid communication with fluid chamber 70 (interior to piston 56) via fluid passageway 72. For purposes of generating a fluid flow into chambers 60 and 70, there is provided a fluid passageway 76 formed at a lower end 78 of piston body portion 64, which is arranged for fluid communication at one end thereof with piston fluid chamber 70 and at another end thereof with fluid channel 80 formed in baseplate 62, which in turn is arranged for fluid communication with fluid channel 82 also formed in baseplate 62. Fluid channel 82 is coupled to a source of pressurized hydraulic fluid such as an oil pump (not shown), although any other fluid supply apparatus and other types of hydraulic fluids may be used. It should also be apparent that variably pressurized fluid chamber 60 may be hydraulically pressurized using other suitable arrangements, such as other fluid paths providing a fluid flow directly into fluid chamber 60 rather than through fluid chamber 70. In operation, the pressurization of variably pressurized fluid chamber 60 is changed by admitting additional fluid into chamber 60 to increase the pressure level or by withdrawing fluid from chamber 60 to relieve the pressure level.

The illustrated shutheight adjustment assembly 50, in accordance with another aspect thereof, further includes the illustrated braking mechanism 54 provided in integral working relationship with piston-cylinder arrangement 52 and which is arranged to establish an adjustable stopping point for the operative movement of cylinder 58 during a non-tensile state of piston 56. In effect, braking mechanism 54 acts to adjustably define, at least in part, the range-of-motion for the operative movement of cylinder 58. Braking mechanism 54, in a preferred form thereof, is provided in the form of a nut-screw arrangement comprising a non-rotatable threaded screw member 84 and a rotatable threaded nut member 86 threadedly engaged to screw member 84. The application of a rotary driving force to nut member 86 acts to rotate nut member 86, which then induces a displacement of screw member 84 that shifts it to a desired braking position that corresponds to an adjustable stopping point for the movement of cylinder 58. In particular, screw member 84 is arranged to enable an interference-type engagement with piston 56 (at its head portion 66) in order to create a braking action in regards to the movement of cylinder 58 and thereby define the adjustable stopping point. In addition, the intermeshing of the respective threaded surfaces of screw 84 and nut 86 is preferably arranged for stable continuous engagement to facilitate an interlocking effect between the components throughout their range of relative positions, helping to eliminate or at least reduce the possibility of slippage therebetween and to firmly hold their position so as to provide a stable stopping point.

Screw member 84 is illustratively provided in the form of a collar-type or ring-like structure annularly disposed about piston 56 and having an outward-facing threaded surface arranged for intermeshing engagement with a complementary threaded surface in opposed relation thereto in nut member 86. Screw member 84 is further arranged with a key-way at an inward-facing surface thereof for sliding registered engagement with a corresponding key member (e.g., spline member 88) fixedly secured to piston 56. The key member and key-way together form an anti-rotational spline attachment between piston 56 and screw member 84 that inhibits rotation of screw member 84 while permitting it to be linearly displaced along the body of piston 56 under a rotating influence applied thereto by nut member 86. Thus, screw member 84 is non-rotationally but slidably coupled to piston 56 via the spline attachment. In addition to its anti-rotating function, the spline attachment effectively serves to guide screw member 84 through its induced displacement. Adjacent to the sidewall structures of piston 56 there is provided a spatial area 98 within which screw member 84 is given ample clearance to move freely under the displacing influence of either the rotating nut member 86 or the linearly moving cylinder 58.

Nut member 86 is illustratively provided in the form of a collar-type or cylindrical-like structure annularly disposed about screw member 84 and having an inner-facing threaded surface arranged for intermeshing engagement with the threaded surface of screw member 84. Nut member 86 is preferably coupled to cylinder 58 so that the integral nut-screw mechanism is arranged to move in tandem with cylinder 58. Nut member 86 is preferably adapted at a lower end thereof for attachment via a connection screw 90 to a driving mechanism provided, for example, in the form of a chain sprocket 92 arranged to drivingly rotate nut member 86. The nut driving mechanism is preferably controlled by a drive motor, which may be integrated into a control system for automatically controlling the bed displacement. It should be apparent that other means may be provided to implement the driving rotation of nut member 86. Nut member 86 is held secure and housed within a retainer structure 94 annularly disposed thereabout. Retainer 94 is preferably provided with elastic properties by forming it to have suitable dimensional characteristics, for example, such as the concave-like cross-sectional profile indicated generally at 96, so as to accommodate any stretch-type forces that may be developed therein in association with any tensile activity occurring in piston 56. Although the illustrated braking mechanism 54 is provided in the form of a non-rotatable screw member 84 and a rotatable nut member 86, this embodiment is disclosed for illustrative purposes only as it should be apparent that the present invention encompasses other arrangements including, for example, any combination of male and female threaded members adapted for relative rotation therebetween in a manner sufficient to establish an adjustable stopping point for the movement of cylinder 58.

The braking activity afforded by the integral nut-screw mechanism is best illustrated in reference to FIG. 3, which depicts both the advancement of screw member 84 to establish an adjustable stopping point and the brake-producing mechanical-type interference caused by screw member 84 as it comes into abutting contact (at a terminal head portion 100 thereof) with piston 56 (at an undersurface of piston head portion 66). For purposes of illustration, it may be assumed that FIG. 2 depicts a representative start-up configuration in which screw member 84 has not been actuated, i.e., it has not been displaced relative to nut member 86. FIG. 3, by comparison, illustrates an actuated state for screw member 84 in which a controllable driving rotation of nut member 86 has produced the indicated advancement of screw member 84 along spline 88. Additionally, hydraulic fluid has been admitted into variably pressurized fluid chamber 60 to cause cylinder 58 (and the attached press machine bed) to move in relation to piston 56 and effect a shutheight adjustment. If the pressurization of fluid chamber 60 reaches a certain level associated with the adjustable stopping point defined by screw member 84, the continued movement of cylinder 58 will be opposed by the interference that results as screw member 84, which also moves as cylinder 58 is being displaced, is brought into contacting engagement with piston 56 at its head portion 66. However, according to the present invention, it is possible for there to be movement of cylinder 58 beyond this adjustable stopping point due to the development of an elastic tensile activity occurring within piston 56 that can accommodate a certain amount of post-braking movement. In particular, the point at which the nut-screw mechanism manifests its braking action (i.e., when there is physical interference between screw 84 and piston head portion 66) is the starting point at which further shutheight changes (i.e., micro-adjustments) can be made by virtue of the elastic stretching of piston 56 in response to increased pressurization of variably pressurized fluid chamber 60 beyond the pressure level associated with the braking point. Specifically, when screw member 84 is in a state of engagement with piston head portion 66, any further increases in the pressurization of fluid chamber 60 will exert a displacing force on cylinder 58, which in turn is communicated through the integrally coupled nut-screw mechanism and applied to piston 56 at the region of braking contact between screw member 84 and piston head portion 66. This application of force to piston 56 produces a tensile effect therein that results in a reversible elongation of piston 56 that shifts cylinder 58 to thereby cause a micro-adjustment of the shutheight. This ability to make micro-adjustments to the shutheight dimension distinguishes over conventional systems that are characterized by a pressure operating range whose bounds are solely determined by whatever braking mechanism is employed to limit the range of travel for the bed-displacing component (e.g., piston or cylinder), thereby providing no capability for extended shutheight adjustment once the braking action takes place. It should be clear that the braking action for shutheight adjustment assembly 50 may also occur even if braking mechanism 54 has not been actuated (i.e., no relative displacement between screw 84 and nut 86), provided that piston-cylinder arrangement 52 has been sufficiently pressurized to cause screw member 84 to come into abutting contact with piston head portion 66.

The illustrated shutheight adjustment assembly 50, in accordance with another aspect of the present invention, is further adapted to define a lubricating chamber shown generally at 102 that encompasses at least the threaded engagement between screw member 84 and nut member 86. Chamber 102 is supplied with lubricating fluid that permits the formation of a continuous, bearing-support, thin-film lubricating layer at the threaded region, enabling the nut-screw mechanism to sustain higher impact forces without incurring fretting or other component damage. Lubricating chamber 102, in one form thereof, is defined at least in part through the use of an arrangement of oil seals that facilitates the hydraulic isolation of the nut-screw mechanism and particularly the threaded surfaces from the surrounding devices. This oil seal arrangement may be illustratively provided by a piston seal 104 disposed in a circumferential groove of piston head portion 66 and arranged to isolate the variably pressurized fluid chamber 60 from the piston side-wall spatial area 98; a retainer seal 106 disposed in retainer structure 94 and arranged to inhibit the migration of oil along the abutting interface between retainer 94 and cylinder 58; an inner seal 108 disposed as shown within a lower end of nut member 86 and arranged to inhibit the migration of oil along the abutting interface between nut member 86 and piston 56; and an outer seal 110 disposed as shown within a lower end of retainer 94 and arranged to inhibit the migration of oil along the abutting interface between retainer 94 and nut member 86. Each of the illustrated oil seals is preferably provided in the form of an annular structure of conventional design. This set of oil seals is shown for illustrative purposes only as it should be apparent that other types of seal formations and non-seal means are available for performing the sealing function. A fluid flow is illustratively provided to lubricating chamber 102 using a fluid passageway 112 formed in cylinder 58, which is arranged for fluid communication with another fluid channel 114 that is coupled to a pressurized fluid supply.

For purposes of describing the operation of shutheight adjustment assembly 50 according to the present invention, reference is now made collectively to FIGS. 2–4. In brief, the shutheight adjustment procedure is implemented in the following manner. The nut-screw mechanism is actuated, if desired, to displace screw member 84 and position it at a point which defines the maximal extent of travel available to cylinder 58 relative to piston 56 (i.e., in its non-tensile state) for the particular selected screw position. Pressurization of variably pressurized fluid chamber 60 produces shutheight variations as cylinder 58 moves in accordance with the pressure level. At the point at which the braking action of the nut-screw mechanism takes effect, further shutheight micro-adjustments are possible over a pressure range that is compatible with the elastic tensile properties of piston 56 and preferably retainer 94.

Referring particularly to FIG. 2, the illustrated configuration for piston-cylinder arrangement 52 corresponds to a baseline pressurization condition in which the piston-cylinder arrangement 52 provides an amount of bearing support sufficient to handle the press tonnage to which it is subjected but not adequate enough to displace cylinder 58. This condition of stability represents a type of lift-off point that establishes a lower bound for the pressurization level that must be sustained. Otherwise, the piston-cylinder arrangement 52 will enter into a compression state in which the combined weight of cylinder 58 and the full weight of the overlying machinery (e.g., bolster and die set) are applied to piston 56. From this lift-off threshold pressurization level, further increases in the pressurization of fluid chamber 60 will cause a displacement of cylinder 58, subject of course to the possibility of any braking action instituted by the nut-screw mechanism.

Referring to FIGS. 3 and 4, there is first illustrated in FIG. 3 an intermediate pressurization condition in which braking mechanism 54 has been actuated to establish a more limited range-of-motion for cylinder 58 relative to its non-actuated state characterized by no advancement of screw member 84. As shown, the variably pressurized fluid chamber 60 has been pressurized (relative to the threshold level of FIG. 2) by the injection of pressurized fluid therein to cause cylinder 58 to be displaced in an amount at least sufficient to cause the illustrated abutting engagement between screw member 84 and piston head portion 66, which represents the occurrence of the braking action. There is further illustrated in FIG. 4 a maximum pressurization condition in which braking mechanism 54 remains in its non-actuated state and the variably pressurized fluid chamber 60 has been sufficiently pressurized to cause cylinder 58 to be displaced in an amount at least sufficient to reach the occurrence of the braking activity. This configuration for piston-cylinder arrangement 52 in FIG. 4 represents the maximal extent of travel for cylinder 58 associated with the non-tensile operating mode for piston 56. In accordance with the present invention, further shutheight adjustments may be made within the configurations shown in FIGS. 3 and 4 by varying the pressurization level of fluid chamber 60 within a pressure operating range compatible with the elastic tensile characteristics of at least piston 56. The shutheight micro-adjustments are reversible by reducing the pressurization level through the removal of fluid from chamber 60, provided that the elastic tensile limits have not been exceeded. FIGS. 2–4 illustrate representative operating configurations for shutheight adjustment assembly 50 and should therefore not be considered in limitation of the present invention, as it should be apparent that other configurations are possible if accompanied by the proper actuation of braking mechanism 54 and the proper pressurization of variably pressurized fluid chamber 60. Shifting among various operating configurations is likewise possible through a similar practice involving the suitable handling of braking mechanism 54 and fluid chamber 60.

Figure 5:
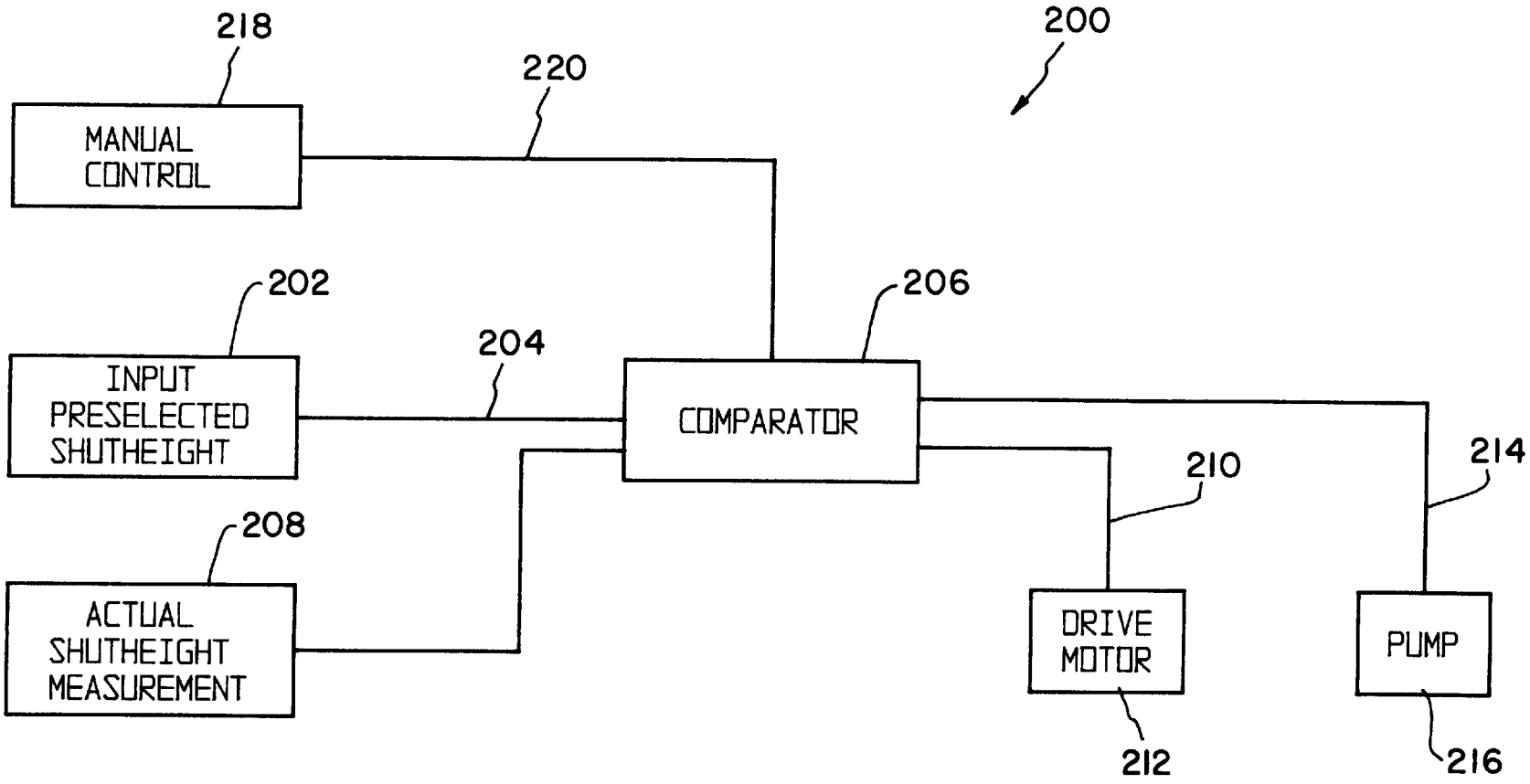
FIG. 5 is a diagrammatic illustration of a control system that monitors the press machine operation and incorporates the shutheight adjustment assembly of the present invention into a control feedback loop that allows real-time continuous adjustments to be made to the shutheight dimension based on the monitoring data.

Referring to FIG. 5, there is shown in block diagram format an automatic shutheight control system for use in conjunction with shutheight adjustment assembly 50 of the present invention. Automatic control of the shutheight dimension is maintained by a control or feedback system 200. Prior to operation, the press operator inputs a preselected shutheight 202 through line 204 into comparator 206. Feedback means 200 together with comparator 206 may comprise a microprocessor as known in the art or may incorporate other pertinent technology, such as programmable logic controllers. Comparator 206 receives input signals and provides output or control signals as a function of the input data.

A shutheight measuring means (not shown) of conventional construction, such as a detector or other form of sensing device, dynamically transmits an actual shutheight measurement 208 particularly during press operation. Comparator 206 compares the difference between the preselected shutheight 202 and the actual shutheight 208 and generates a control signal on line 210 supplied to a drive means such as control motor 212 coupled to chain sprocket 92 associated with the nut-screw mechanism, and generates another control signal on line 214 supplied to a pressurized oil source such as oil pump 216. Pump 216 is arranged for fluid communication with variably pressurized fluid chamber 60 in the manner described herein to controllably vary the hydraulic pressurization therein. The dynamically-generated results of the control-type comparator function performed by comparator 206 are embodied in the control signals on lines 210 and 214, which provide drive motor 212 and pump 216 with the appropriate signals for implementing and putting into effect any indicated displacement activity using the variable pressurization of piston-cylinder arrangement 52 in conjunction with the braking activity furnished by braking mechanism 54. Comparator 206 may be overridden via a manual control circuit 218 along line 220 for direct control of motor 212 and pump 216. The displacement activity may occur as needed during press operation and/or during a non-cycling interval. The disclosed control system is shown for illustrative purposes only as it should be understood and appreciated that alternative control arrangements may be utilized in conjunction with the shutheight adjustment assembly of the present invention.

What has been shown and described herein is an hydraulic piston-cylinder arrangement for adjustably providing bearing support to the bed or bolster assembly of a press machine. The piston member has a property of tensile elasticity that permits it to be reversibly extended to facilitate micro-adjustments to the shutheight dimension. This elastic tensile characteristic specifically gives rise to a pressure operating range that allows micro-adjustments to be made to the shutheight relative to the shutheight value associated with the maximally permissible cylinder position as determined by the current configuration of the nut-screw mechanism. This extended operating range made available by the elastic tensile properties of the piston device is not currently part of conventional systems. There has also been developed an integrated shutheight system employing a sensor-type monitoring apparatus to detect shutheight position and provide the piston-cylinder hydraulic control apparatus with control signals that are used to vary the pressurization level and hence the cylinder position and shutheight dimension. Additionally, the adjustable stop mechanism provided in the form of the integral nut-screw combination has been enclosed within a fully lubricated and sealed chamber to enhance its bearing support capabilities.

The present invention facilitates access to the die assembly to remedy malfunctions due to binding or jamming and to service the individual die members. The piston-cylinder assembly therefore exhibits a usage in press set-up applications and during other pre-cycling activities. The shutheight adjustment assembly is particularly well suited for making adjustment-in-motion modifications to the shutheight. The use of a movable cylinder for providing the direct bearing support to the bed portion facilitates greater stability relative to piston-based bed couplings since the cylinder provides a significantly greater area over which the elevating or lowering force may be distributed and applied. The preferred placement of the shutheight adjustment assembly 50 at an underside location relative to the bed portion is a more favorable design over conventional apparatus that are interposed between the bed and crown. The underside configuration also eliminates the various types of accessing interference found in conventional systems that have to contend with the adjustment apparatus being disposed in the access pathway leading to the die set. The present invention is also distinguished by virtue of its implementing shutheight changes through repositioning of the bed, as compared to other systems that utilize apparatus affecting the slide and/or crown placement. Although a single piston-cylinder arrangement 52 has been shown and described herein, this should not be considered in limitation of the present invention since it is possible to arrange a plurality of such units to simultaneously provide adjustable support to the bed.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An assembly for use in a press machine having a position-adjustable bed, said assembly comprising:

a piston-cylinder combination operatively coupled to said bed; and at least one variably pressurizable fluid chamber defined by said piston-cylinder combination;

wherein the cylinder of said piston-cylinder combination being operatively movable in response to changes in the pressurization of said at least one variably pressurizable fluid chamber;

wherein the piston of said piston-cylinder combination being characterized by a property of tensile elasticity in at least one dimension thereof substantially parallel with a shutheight dimension of said press machine.

2. The assembly as recited in claim 1, wherein the cylinder of said piston-cylinder combination having a normal range-of-motion, the cylinder being capable of displacement beyond the normal range-of-motion by sufficiently pressurizing said piston-cylinder combination to induce a tensile action in the piston.

3. The assembly as recited in claim 1, wherein during at least one selectable operating mode said piston-cylinder combination being sufficiently selectively pressurized to actuate a tensile activity in the piston.

4. The assembly as recited in claim 1, where said at least one variably pressurizable fluid chamber further comprises:

a first fluid chamber defined at an interior space of the piston; and a second fluid chamber defined between the piston and the cylinder, the first fluid chamber being arranged in fluid communication with the second fluid chamber.

5. The assembly as recited in claim 1, wherein the cylinder being coupled to an underside of said bed.

6. The assembly as recited in claim 1, further comprises:

a mechanism to define an adjustable normal stopping point for the operative movement of the cylinder.

7. The assembly as recited in claim 6, wherein said piston-cylinder combination being selectively operable in at least one state thereof to enable displacement of the cylinder beyond the normal stopping point defined by said mechanism by sufficiently pressurizing said piston-cylinder combination to induce a tensile effect in the piston.

8. The assembly as recited in claim 6, wherein said mechanism further comprises:

a non-rotatable threaded screw member attached to, and displaceable along, the piston of said piston-cylinder combination; and a rotatable threaded nut member in threading engagement with aid screw member.

9. The assembly as recited in claim 8, wherein said crew member being arranged to enable operative engagement with a portion of the piston to cooperatively define therewith the normal stopping point for the operative movement of the cylinder.

10. The assembly as recited in claim 9, wherein:

said nut member being coupled to the cylinder of said piston-cylinder combination; and wherein the portion of the piston with which said screw member being arranged to enable engagement therewith in association with cooperatively defining the normal stopping point for the movement of the cylinder being a head portion of the piston.

11. The assembly as recited in claim 8, wherein said mechanism further comprises:

means to activate said nut member to operatively effect a selectively variable displacement of said screw member.

12. The assembly as recited in claim 8, wherein said screw member and said nut member being arranged to move in tandem with the cylinder of said piston-cylinder combination.

13. The assembly as recited in claim 8, further comprises:

means for defining a chamber encompassing at least a portion of the threading engagement between said screw member and said nut member; and means for providing lubricating fluid to said chamber.

14. The assembly as recited in claim 1, wherein said piston-cylinder combination being arranged to support said bed.

15. An assembly for use in a press machine having a position-adjustable bed, said assembly comprising:

a selectively pressurizable piston-cylinder combination operatively coupled to said bed; and a mechanism to define a normal range-of-motion for the cylinder of said piston-cylinder combination;

wherein the cylinder of said piston-cylinder combination being operatively movable in response to changes in the pressurization of said piston-cylinder combination;

wherein the piston of said piston-cylinder combination having a property of tensile elasticity in at least one dimension thereof.

16. The assembly as recited in claim 15, wherein the at least one dimension of the piston associated with the property of tensile elasticity being substantially parallel to a shutheight dimension of said press machine.

17. The assembly as recited in claim 15 wherein the normal range-of-motion for the cylinder as defined by said mechanism being adjustable.

18. The assembly as recited in claim 15, further comprises:

at least one variably pressurizable fluid chamber defined by said piston-cylinder combination.

19. The assembly as recited in claim 18, where said at least one variably pressurizable fluid chamber further comprises:

a first fluid chamber defined at an interior space of the piston; and a second fluid chamber defined between the piston and the cylinder, the first fluid chamber being arranged in fluid communication with the second fluid chamber.

20. The assembly as recited in claim 15, wherein said piston-cylinder combination being selectively operable in at least one state thereof to enable displacement of the cylinder beyond the normal range-of-motion defined by said mechanism by sufficiently pressurizing said piston-cylinder combination to induce a tensile effect in the piston.

21. The assembly as recited in claim 15, wherein the cylinder being capable of displacement beyond the normal range-of-motion defined by said mechanism by sufficiently pressurizing said piston-cylinder combination to induce a tensile action in the piston.

22. The assembly as recited in claim 15, wherein the cylinder being coupled to an underside of said bed.

23. The assembly as recited in claim 15, wherein said mechanism further comprises:

a non-rotatable threaded screw member attached to, and displaceable along, the piston of said piston-cylinder combination;

a rotatable threaded nut member in threading engagement with said screw member; and a means to activate said nut member to operatively actuate a selectively variable displacement of said screw member.

24. The assembly as recited in claim 15, wherein said piston-cylinder combination being arranged to support said bed.

25. A press machine, comprising:

a frame structure with a crown and a position-adjustable bed;

a slide guided by the frame structure for operative movement in opposed relation to said bed;

a drive assembly attached to said frame structure for operatively driving said slide;

a bolster assembly mounted to said bed; and a selectively pressurizable piston-cylinder combination operatively coupled to said bed;

wherein the cylinder of said piston-cylinder combination being operatively movable in response to changes in the pressurization of said piston-cylinder combination;

wherein the piston of said piston-cylinder combination having a property of tensile elasticity in at least one dimension thereof substantially parallel with a shutheight dimension of said press machine.

26. The press machine as recited in claim 25, wherein the cylinder of said piston-cylinder combination having a normal range-of-motion, the cylinder being capable of displacement beyond the normal range-of-motion by sufficiently pressurizing said piston-cylinder combination to induce a tensile action in the piston.

27. The press machine as recited in claim 25, wherein during at least one selectable operating mode said piston-cylinder combination being sufficiently selectively pressurized to actuate a tensile activity in the piston.

28. The press machine as recited in claim 25, further comprises:

at least one variably pressurizable fluid chamber defined by said piston-cylinder combination.

29. The press machine as recited in claim 28, where said at least one variably pressurizable fluid chamber further comprises:

a first fluid chamber defined at an interior space of the piston; and a second fluid chamber defined between the piston and the cylinder, the first fluid chamber being arranged in fluid communication with the second fluid chamber.

30. The press machine as recited in claim 25, wherein the cylinder being coupled to an underside of said bed.

31. The press machine as recited in claim 25, further comprises:

a mechanism to define an adjustable normal stopping point for the operative movement of the cylinder.

32. The press machine as recited in claim 31, wherein said piston-cylinder combination being selectively operable in at least one state thereof to enable displacement of the cylinder beyond the normal stopping point defined by said mechanism by sufficiently pressurizing said piston-cylinder combination to induce a tensile effect in the piston.

33. The press machine as recited in claim 31, wherein said mechanism further comprises:

a non-rotatable threaded screw member attached to, and displaceable along, the piston of said piston-cylinder combination; and a rotatable threaded nut member in threading engagement with said screw member.

34. The press machine as recited in claim 33, wherein said screw member being arranged to enable operative engagement with a portion of the piston to cooperatively define therewith the normal stopping point for the operative movement of the cylinder.

35. The press machine as recited in claim 34, wherein:

said nut member being coupled to the cylinder of said piston-cylinder combination; and wherein the portion of the piston with which said screw member being arranged to enable engagement therewith in association with cooperatively defining the normal stopping point for the movement of the cylinder being a head portion of the piston.

36. The press machine as recited in claim 33, wherein said mechanism further comprises:

means to activate said nut member to operatively effect a selectively variable displacement of said screw member.

37. The press machine as recited in claim 33, wherein said screw member and said nut member being arranged to move in tandem with the cylinder of said piston-cylinder combination.

38. The press machine as recited in claim 33, further comprises:

means for defining a chamber encompassing at least a portion of the threading engagement between said screw member and said nut member; and means for providing lubricating fluid to said chamber.

39. The press machine as recited in claim 25, wherein said piston-cylinder combination being arranged to support said bed.

40. A press machine, comprising:

a frame structure with a crown and a position-adjustable bed;

a slide guided by the frame structure for operative movement in opposed relation to said bed;

a drive assembly attached to said frame structure for operatively driving said slide;

a bolster assembly mounted to said bed;

a selectively pressurizable piston-cylinder combination operatively coupled to said bed; and a mechanism to define a normal range-of-motion for the cylinder of said piston-cylinder combination;

wherein the cylinder of said piston-cylinder combination being operatively movable in response to changes in the pressurization of said piston-cylinder combination;

wherein the piston of said piston-cylinder combination having a property of tensile elasticity in at least one dimension thereof.

41. The press machine as recited in claim 40, wherein the at least one dimension of the piston associated with the property of tensile elasticity being substantially parallel to a shutheight dimension of said press machine.

42. The press machine as recited in claim 40, wherein the normal range-of-motion for the cylinder as defined by said mechanism being adjustable.

43. The press machine as recited in claim 40, further comprises:

at least one variably pressurizable fluid chamber defined by said piston-cylinder combination.

44. The press machine as recited in claim 43, where said at least one variably pressurizable fluid chamber further comprises:

a first fluid chamber defined at an interior space of the piston; and a second fluid chamber defined between the piston and the cylinder, the first fluid chamber being arranged in fluid communication with the second fluid chamber.

45. The press machine as recited in claim 40, wherein said piston-cylinder combination being selectively operable in at least one state thereof to enable displacement of the cylinder beyond the normal range-of-motion defined by said mechanism by sufficiently pressurizing said piston-cylinder combination to induce a tensile effect in the piston.

46. The press machine as recited in claim 40, wherein the cylinder being capable of displacement beyond the normal range-of-motion defined by said mechanism by sufficiently pressurizing said piston-cylinder combination to induce a tensile action in the piston.

47. The press machine as recited in claim 40, wherein the cylinder being coupled to an underside of said bed.

48. The press machine as recited in claim 40, wherein said mechanism further comprises:

a non-rotatable threaded screw member attached to, and displaceable along, the piston of said piston-cylinder combination;

a rotatable threaded nut member in threading engagement with said screw member; and a means to activate said nut member to operatively actuate a selectively variable displacement of said screw member.

49. The press machine as recited in claim 40, wherein said piston-cylinder combination being arranged to support said bed.

* * * * *